US005899977A

United States Patent [19]

Nakamura

[11] Patent Number: 5,899,977

[45] Date of Patent: May 4, 1999

[54] ACOUSTIC SIGNAL PROCESSING APPARATUS WHEREIN PRE-SET ACOUSTIC CHARACTERISTICS ARE ADDED TO INPUT VOICE SIGNALS

[75] Inventor: Junichi Nakamura, Chiba, Japan

[73] Assignee: Sony Corporation, Tokyo, Japan

[21] Appl. No.: 08/883,307

[22] Filed: Jun. 26, 1997

[30] Foreign Application Priority Data

Jul. 8, 1996 [JP] Japan ..... 8-178295

[51] Int. Cl.[6] ..... G10L 9/00

[52] U.S. Cl. ..... 704/278; 704/502; 704/201; 704/500; 360/60

[58] Field of Search ..... 704/278, 201, 704/500, 507, 502, 503, 504; 84/609, 603; 434/308; 360/60; 375/327

[56] References Cited

U.S. PATENT DOCUMENTS

| | | | |
|---|---|---|---|
| 4,638,506 | 1/1987 | Han | 381/34 |
| 5,130,864 | 7/1992 | Shimada | 360/60 |
| 5,278,346 | 1/1994 | Yamaguchi | 84/609 |
| 5,323,275 | 6/1994 | Himeno et al. | 360/32 |
| 5,442,711 | 8/1995 | Toyama | 381/63 |
| 5,483,555 | 1/1996 | Hattori | 375/327 |
| 5,495,247 | 2/1996 | Yamamoto et al. | 341/159 |
| 5,569,038 | 10/1996 | Tubman et al. | 434/308 |
| 5,621,182 | 4/1997 | Matsumoto | 84/610 |
| 5,641,926 | 6/1997 | Gibson et al. | 84/603 |
| 5,750,912 | 5/1998 | Matsumoto | 84/609 |

*Primary Examiner*—David R. Hudspeth
*Assistant Examiner*—Vijay B. Chawan
*Attorney, Agent, or Firm*—Jay H. Maioli

[57] ABSTRACT

An acoustic signal processing device used in, for example, karaoke systems, includes a signal processor, a digital/analog converter and a mixer. The signal processor converts the input analog acoustic signal into a digital signal and processes the converted digital signal by signal processing for generating a digital signal added to with pre-set acoustic characteristics. The digital/analog converter converts the digital signal generated by the signal processor into an analog signal. The mixer mixes the input analog signal with the analog signal outputted by the digital/analog converter.

8 Claims, 4 Drawing Sheets

ACOUSTIC SIGNAL PROCESSING APPARATUS WHEREIN PRE-SET ACOUSTIC CHARACTERISTICS ARE ADDED TO INPUT VOICE SIGNALS

BACKGROUND OF THE INVENTION

1. Field of the Invention

This invention relates to an acoustic signal processing apparatus. More particularly, it relates to an acoustic signal processing apparatus in which pre-set acoustic characteristics are added to input voice signals.

2. Description of the Related Art

The present Assignee has proposed in Japanese patent Application No.6-176775 (Japanese Patent lying-Open No.8-44389) entitled 'Acoustic Signal Processing Apparatus' an acoustic signal processing apparatus in which the input voice and the voice having an interval spaced by a pre-set pitch from the interval of the input voice are synthesized to give an acoustic effect (unison effect) in which plural singers are singing despite the fact that only one person is singing. The 'unison' herein means singing or music performance in unison.

FIG. 1 shows, in a block diagram, an acoustic signal processing apparatus 101 for according the unison effect as proposed in Japanese Laying Open Patent No.8-4389. The acoustic signal processing apparatus 101 includes a microphone amplifier 102 for amplifying an input signal from a microphone (M-IN), such as voice of a performer entered via a microphone, not shown, and an A/D converter 103 for converting acoustic signals amplified by the microphone amplifier 102 into digital acoustic signals. The acoustic signal processing apparatus 101 also includes a unison voice generator 104 and a line amplifier 105 for amplifying an input signal (L-IN), such as musical performance signals, as accompaniment, reproduced by a compact disc reproducing device or a video disc reproducing device. The acoustic signal processing apparatus 101 also includes an A/D converter 106 for converting the music performance signals, amplified by the line amplifier 105, into digital music signals, a key control circuit 107, a music vocal mixing unit 108 and a D/A converter 109.

The unison voice generator 104 includes an interval converting circuit 110 and a synthesizing circuit 111. The interval converting circuit 110 converts the interval of the digital signal into signals of an interval spaced apart a pre-set pitch from the interval of the input acoustic signal. The synthesis circuit 111 synthesizes the digital signal and an output digital signal of the interval converting circuit 110 by digital signal processing.

The result is that the acoustic signal processing apparatus 101 synthesizes the singing voice of a vocal performer with the singing voice of an interval different from the interval of the singing voice of the performer, even if only one vocal performer is singing, thus giving the unison effect, that is the effect as if plural vocal performers are singing. The acoustic signal processing apparatus 101 may also be configured so that it has plural interval conversion circuits 110 for generating plural different singing voices of different intervals and synthesizing the different singing voices. With the acoustic signal processing apparatus 101, the user can optionally select whether or not the unison effect is used, or set the pitch for interval conversion.

The key control circuit 107 can convert the interval of the music performance signals from, for example, a compact disc reproducing apparatus, based on an interval specifying signal as set by the user, to output the converted music performance signals.

The music vocal mixing unit 108 includes an equalizer 112 for generating, by digital signal processing, a digital signal converted in frequency characteristics based on an output digital signal from the unison voice generating unit 104, and a synthesis circuit 113 for synthesizing the digital signal outputted by the unison voice generating unit 104 and the digital signal outputted by the equalizer 112. The music vocal mixing unit 108 also includes an echo processing circuit 114 for generating an echo by digital signal processing based on the output digital signals of the synthesis circuit 113 and a synthesis circuit 115 for synthesizing, by digital signal processing, the output digital signal of the synthesis circuit 113 and digital signals equivalent to an echo outputted by the echo processing circuit 114. The music vocal mixing unit 108 also includes an equalizer 116 for converting, by digital signal processing, the frequency characteristics of the digital signal as accompaniment outputted by the key control circuit 107 and a synthesis circuit 117 for synthesizing the output digital signal of the synthesis circuit 115 and the output digital signal of the equalizer 116.

The equalizers 112, 116 can set the frequency characteristics desired by the user. The frequency characteristics of the equalizers 112, 116 can be adjusted separately or together. The echo time of the echo sound generated by the echo processing circuit 114 can be optionally set by the user.

The output digital signals of the synthesis circuit 117, synthesized from the vocal and the music, are converted by the D/A converter 109 into analog vocal/music signals so as to be outputted as acoustic output signal (A-OUT).

In the above-described acoustic signal processing apparatus 101, the input signal from a microphone is converted by the A/D converter 103 into digital signals, which are then processed by digital signal processing for according the vocal having the interval different from that of the vocal entered via the microphone, converting the frequency or according the echo. Since the acoustic signal processing apparatus 101 performs the signal processing as digital signal processing, high-precision digital processing operations are required, thus requiring high-performance A/D converter 103 or D/A converter 109 with a larger number of bits and with a higher sampling frequency.

The acoustic quality of the acoustic signal processing apparatus depends to a large extent on the performance of the A/D converter or the D/A converter in use, such that, if inexpensive A/D converter or D/A converter with low signal processing accuracy is used, sufficient acoustic quality cannot be assured. It is therefore necessary to use an A/D converter 103 or a D/A converter 109 that are high in signal processing accuracy and therefore are rather expensive.

In the acoustic signal processing apparatus 101, if the unison effect, modification of the frequency characteristics by the equalizer or the echo effect is not used but simply the voice as collected by the microphone and the accompaniment are synthesized to produce the acoustic output signal (A-OUT), the number of quantization bits needs to be increased for securing a sufficient dynamic range for faithfully processing the voice by digital signal processing. In addition, the sampling frequency needs to be high for securing the sufficient acoustic signal quality. The result is that the acoustic signal processing apparatus 101 is complex in hardware structure and expensive A/D and D/A converters need to be used, thus raising the cost.

In the acoustic signal processing apparatus 101, pre-set delay is produced due to digital signal processing of the input microphone signal. In addition, in digital signal processing, the quantization noise is unavoidably produced in digital signal processing. Thus, if the acoustic signal processing apparatus is applied to a karaoke system in which the input via the microphone is outputted on a real-time basis, a phase difference or time shift is generated between the microphone input and the signal processed by digital signal processing, or the signal-to-noise (SN) ratio is lowered. Because of this a desired high acoustic effect cannot be achieved.

SUMMARY OF THE INVENTION

It is therefore an object of the present invention to provide an acoustic signal processing apparatus which resolves the above-mentioned problems.

According to the present invention, there is provided an acoustic signal processing device used in, for example, karaoke, including a signal processor, a digital/analog converter and a mixer. The signal processor converts the input analog acoustic signal into a digital signal and processes the converted digital signal by signal processing for generating a digital signal added to with pre-set acoustic characteristics. The digital/analog converter converts the digital signal generated by the signal processor into an analog signal. The mixer mixes the input analog signal with the analog signal outputted by the digital/analog converter.

DESCRIPTION OF THE PREFERRED EMBODIMENTS

Figure 1:
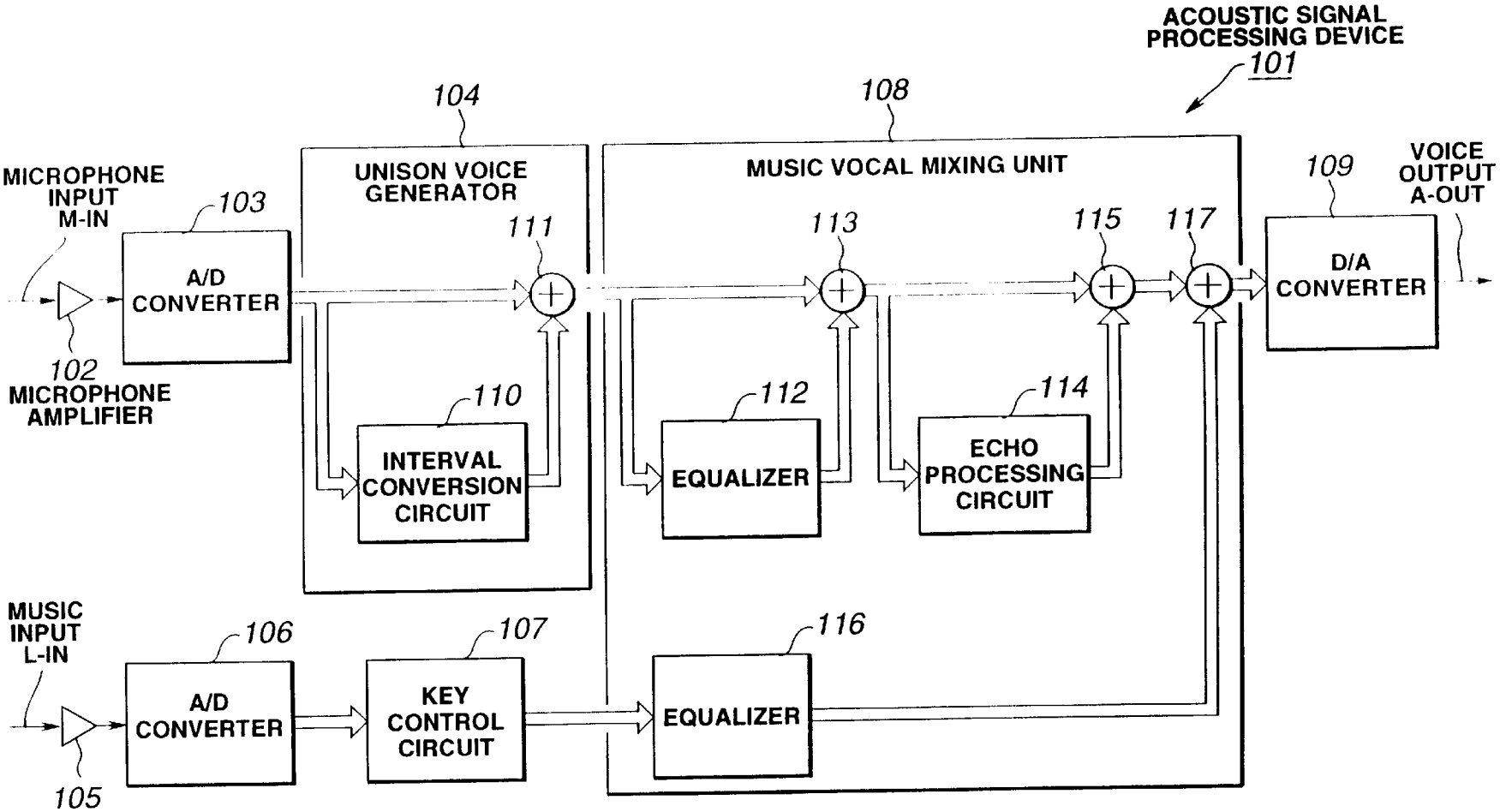
FIG.1 (PRIOR ART)
FIG. 1 is a block diagram showing the structure of an acoustic signal processing apparatus which forms the basis for the present invention.

Referring to the drawings, an acoustic signal processing device according to the present invention will be explained in detail. In the following description, the acoustic signal processing device of the present invention is applied to a karaoke unit.

Figure 2:
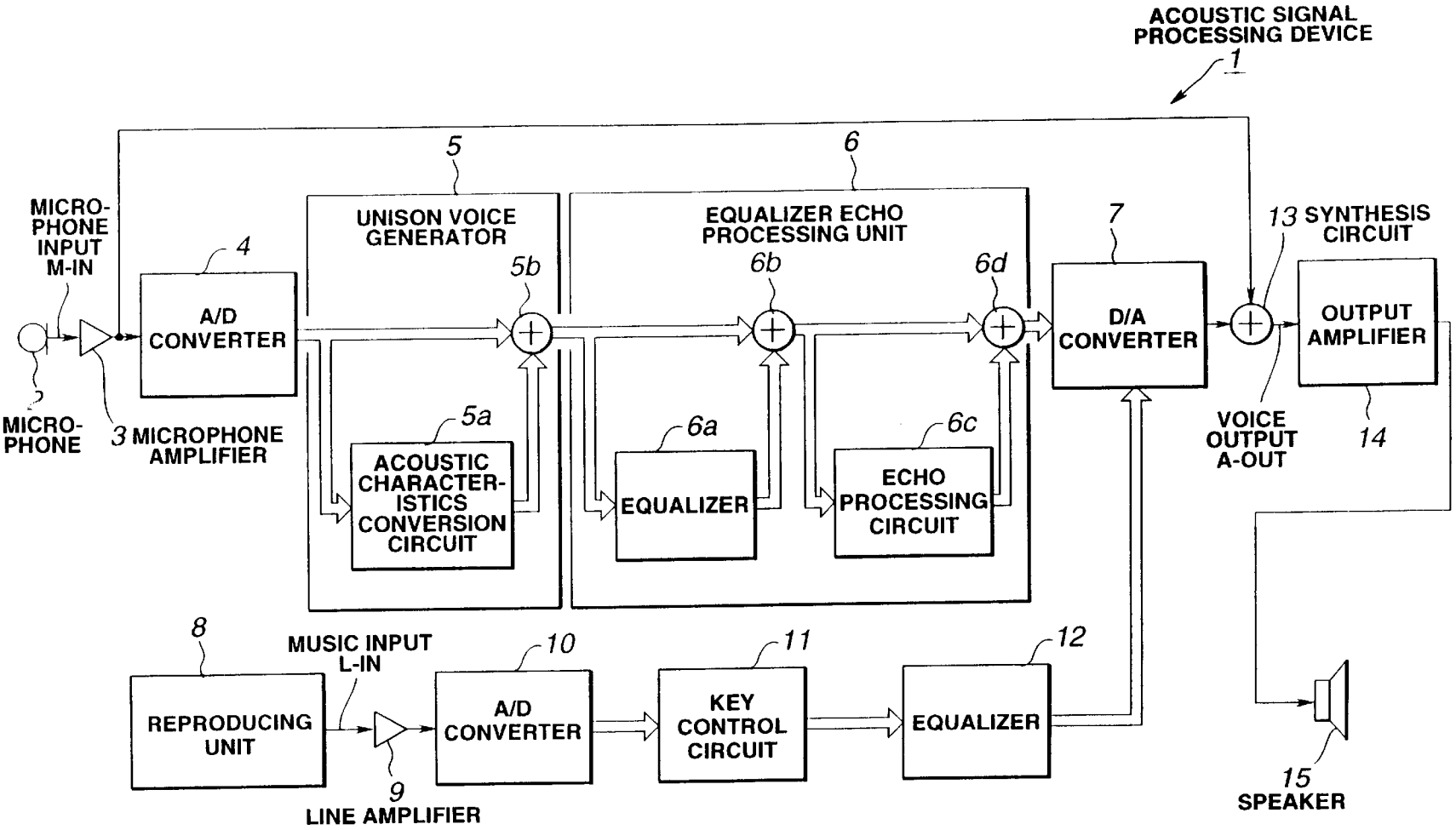
FIG. 2 is a is a block diagram of an acoustic signal processing apparatus according to a first embodiment of the present invention.

FIG. 2 shows a block diagram of an acoustic signal processing device 1 embodying the present invention. The acoustic signal processing device 1 includes a microphone amplifier 3 for amplifying an input signal from an amplifier (M-IN), such as the voice of a singer (vocal performer) entered via a microphone 2, and an A/D converter 4 for converting the analog voice signals amplified by the microphone 3 into digital signals. The acoustic signal processing device 1 also includes a unison voice generator 5, an equalizer-echo processor 6 and a D/A converter 7.

The acoustic signal processing device 1 further includes a line amplifier 9 for amplifying a music input signal (L-IN) of the music performance signal, as so-called accompaniment, reproduced by a reproducing device employing as a recording medium a compact disc or a video disc having recorded thereon the information such as the lyrics or the music information as accompaniment. The acoustic signal processing device 1 additionally includes an A/D converter 10 for converting the music performance signals, amplified by the line amplifier 9, into digital signals, a key control circuit 11, an equalizer 12 and a synthesis circuit 13. An output signal of the synthesis circuit 13 is amplified by an output amplifier 14 so as to be supplied to a speaker 15.

In the above-described acoustic signal processing apparatus 101, the digital signal added to with unison voice or the echo signal, and the output digital signal of the equalizer 16, are synthesized by the synthesis circuit 117. In the acoustic signal processing device 1, the acoustic signal output of the microphone amplifier 3 and an effect sound containing signal added to with the unison voice or the echo sound by digital signal processing and D/A converted by the D/A converter 7 are summed and synthesized by the synthesis circuit 13 without resorting to digital signal processing. The acoustic signal processing device 1 includes a D/A converter 7 downstream of the equalizer-echo processing unit 6. The output of the D/A converter 7 is synthesized by the synthesis circuit 13 to the output signal from the microphone amplifier 3.

The A/D converter 4 for A/D converting an output signal of the microphone amplifier 3 and the D/A converter 4 for D/A converting an output signal of the equalizer-echo processing unit 6 use bits smaller in number than those used in the A/D converter 103 or the D/A converter 109 of the above-mentioned acoustic signal processing apparatus 101. Meanwhile, the A/D converter 4 and the D/A converter 7 may be designed with a sampling frequency lower than that for the A/D converter 103 or the D/A converter 109 of the above-mentioned acoustic signal processing apparatus 101. In addition, the the A/D converter 4 and the D/A converter 7 may be designed to have a smaller number of bits and with a lower sampling frequency simultaneously.

The unison voice generating unit 5 includes an acoustic characteristics converting circuit 5*a* and a synthesis circuit 5*b*. The acoustic characteristics converting circuit 5*a* converts the acoustic signal entered via the microphone into a signal having an interval spaced apart by a pre-set pitch from the interval of the microphone input signal by, for example, digital signal processing. The interval converting pitch of the acoustic characteristics converting circuit 5*a* may be a pre-set constant value or may be controlled based on the result of detection by a voice volume detection circuit for the input acoustic signal, not shown.

The acoustic characteristics converting circuit 5*a* may be configured for recording an ID signal specifying the genre of the accompaniment music, reproduced by the reproducing device 8, on a recording medium for the accompaniment music as the subcode information if the recording medium is a compact disc, and for automatically selecting the pitch for interval conversion optimum for the genre based on the ID signal. In addition, the acoustic characteristics converting circuit 5*a* may be configured for selecting the pitch based on the result of detection from the above-mentioned voice volume detection circuit. Of course, these two alternatives may be used in combination. The acoustic characteristics converting circuit 5*a* may also be configured for converting the input voice signal into a signal spaced apart a pre-set pitch from the voice quality or frequency of the input voice signal by digital signal processing.

The synthesis circuit 5*b* sums and synthesizes the digital signal from the A/D converter 4 to the output digital signal of the acoustic characteristics converting circuit 5*a* spaced a pre-set pitch from the digital signal from the A/D converter 4. The unison voice generating unit 5 is configured in this manner for producing a unison effect in which the impression as if there are plural vocal performers despite the fact that there is only one vocal performer is produced because plural singing voices each having an interval different from the interval of the performer are synthesized. The unison voice generator 5 can suitably select whether or not the unison effect is used or can optionally set the pitch for interval conversion.

The equalizer echo processor 6 includes an equalizer 6*a*, a synthesis circuit 6*b*, an echo processing circuit 6*c* and a synthesis circuit 6*b*. The equalizer 6*a* corrects and modifies frequency characteristics of output digital signals of the unison voice generator 5 to generate corrected and modified digital signals by digital signal processing. The synthesis circuit 6*b* synthesizes the output digital signal of the unison voice generator 5 and the output digital signal of the equalizer 6*a* by digital signal processing. The equalizer echo processor 6 permits the user to optionally set whether or not the frequency characteristics should be corrected by the equalizer 6*a* or which frequency characteristics should be used. These can be set by the user actuating plural switches mounted on an input unit, not shown, which also permit the user to select the unison effect or set the pitch for interval conversion.

The echo processing circuit 6*c* generates the echo sound by digital signal processing of the output digital signals of the synthesis circuit 6*b*. The echo processing circuit 6*c* permits the user to select whether or not the echo effect should be used or how long the echo time duration should be set in the same way as it permits the user to select the unison effect, set the pitch for interval conversion or to adjust the frequency characteristics by the equalizer 6*a*.

An output signal of the synthesis circuit 6*d* is routed to the D/A converter 7 which then converts the digital signal processed by the unison voice generator 5 and the equalizer echo processor 6 into analog signals.

The key control circuit 11 performs digital signal processing on the output digital signal of the A/D converter 10 to convert the interval of the music performance signals from the reproducing device 8 to output digital signals as interval-converted music performance signals. The key control circuit 11 permits the user to set, subject to the user actuating an input unit, not shown, whether or not key control should be made or to which interval the digital signal should be converted, in the same way as it permits the user to set the frequency characteristics as mentioned above.

An output digital signal of the equalizer 12 is routed as the accompaniment information to the D/A converter 7. The D/A converter 7 converts the output digital signals of the equalizer 12 into analog signals. The analog signals, thus generated by the D/A converter 7, are sent to the synthesis circuit 13.

The synthesis circuit 13 sums the output signals of the microphone amplifier 3 and the output signals of the D/A converter 7 to produce an acoustic output (A-OUT). This synthesis circuit 13 thus adds the unison voice generated by digital signal processing and the echo sound to the voice of the singer collected by the microphone.

Thus, with the present acoustic signal processing device 1, the digital signal processing unit for adding the above-mentioned acoustic characteristics to the input signal from the microphone, made up of the A/D converter 4, unison voice generating unit 5, equalizer echo processing unit 6 and the DA converter 7, can be realized without lowering the acoustic quality of the voice of the singer, while the hardware structure of the digital signal processing unit can be simplified. That is, the unison voice signals generated by the above-mentioned unison voice generating unit 5 or the echo signals generated by the equalizer echo processing unit 6 are signals according special acoustic effects to the voice of the singer. These unison voice signals and the echo signals are subsidiary signals to the main signals which are the voice of the singer. Thus, even if the number of bits is reduced or the sampling frequency of the A/D conversion of the A/D converter 4 is lowered, the output signal of the microphone 2 as the main signal is itself not deteriorated when the signal according the special acoustic effect is added to the main signal. Thus the acoustic output (A-OUT) of the voice synthesized by the synthesis circuit 13 has psychoacoustically unobjectionable acoustic quality.

Thus, with the present acoustic signal processing device, practically sufficient acoustic effects can be achieved even when digital signal processing accuracy is lowered, as described above, thus reducing the production cost.

With the present voice signal processing device, there is no risk that the voice of the singer in the output signal from the synthesis circuits added to with unison voice signals or echo signals be distorted due to, for example, constraint in the dynamic range of the A/D or D/A converters, even if the A/D or D/A converters used are of lower number of bits or lower sampling frequency than those used in the apparatus shown in FIG. 1.

Figure 3:
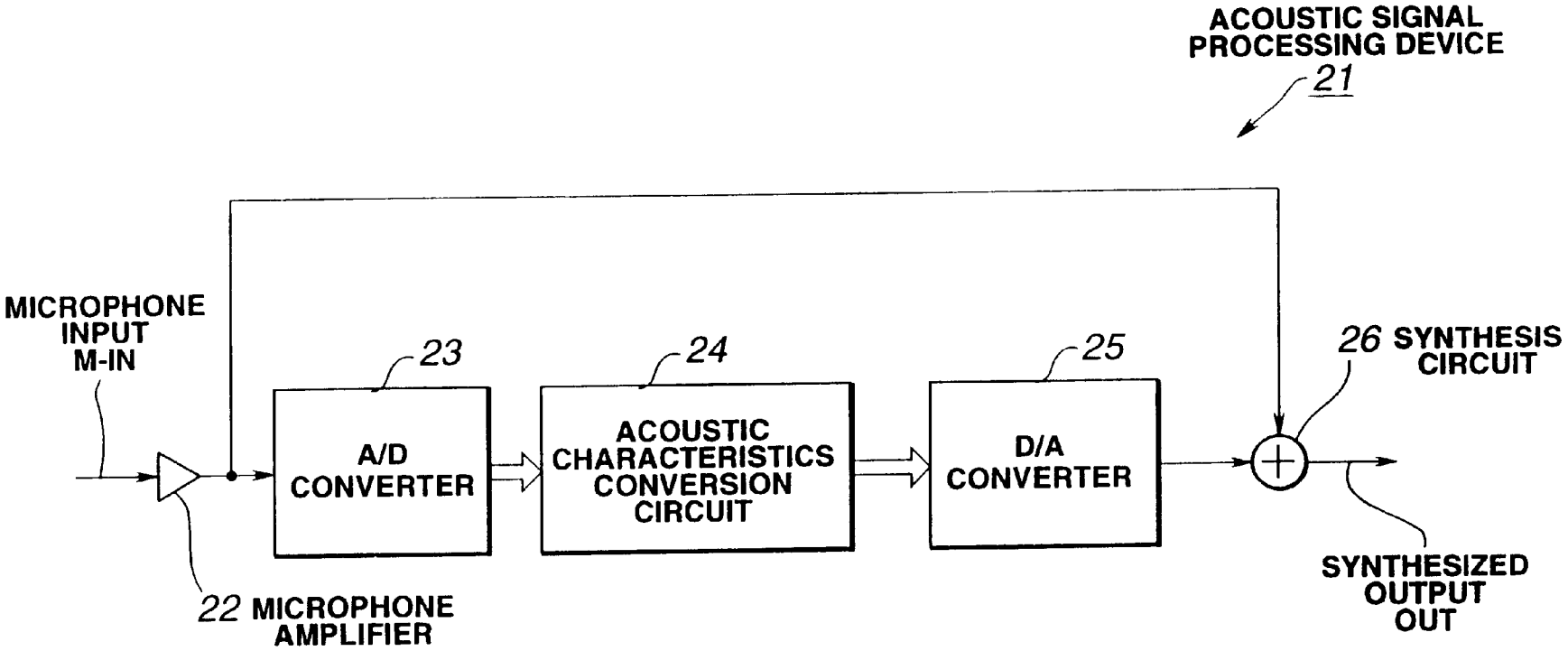
FIG. 3 is a is a block diagram of an acoustic signal processing apparatus according to a second embodiment of the present invention.

Referring to FIG. 3, an acoustic signal processing device 21 according to a second embodiment of the present invention is explained. The acoustic signal processing device 21 is adapted for generating acoustic signals added to with the unison voice, and has basically the same functions as those of the acoustic signal processing device 1 shown in FIG. 2.

The second acoustic signal processing device 21 includes a microphone amplifier 22 for amplifying an output signal corresponding to the voice of the singer collected by a microphone, not shown, and an A/D converter 23 for A/D converting the analog output signal of the microphone amplifier 22. The second acoustic signal processing device 21 also includes an acoustic characteristics conversion circuit 24 for performing digital signal processing on the A/D converted digital acoustic signals for generating digital signals having an interval different from that of the input signal corresponding to the voice of the singer collected by the microphone, and a D/A converter 25 for D/A converting the output digital acoustic signals of the acoustic characteristics conversion circuit 24 for generating analog signals. The second acoustic signal processing device 21 further includes a synthesis circuit 26 for synthesizing the analog signal having an interval different from the interval of the voice of the singer outputted by the D/A converter 25 and the output signal of the microphone amplifier 22.

If, in the second embodiment, the unison effect as if plural singers having different intervals are singing one and the same song is desired, it suffices to provide plural acoustic characteristics conversion circuit 24 in parallel with the microphone amplifier 22 and to synthesize outputs of the conversion circuits by the synthesis circuit 26. If an output of the synthesis circuit 26 is adapted to be fed back to the input of the A/D converter 23 by a feedback loop via an amplifier having means for varying the amplification factor, a unison effect similar to that realized with the use of plural acoustic characteristics conversion circuits may be achieved with the sole acoustic characteristics conversion circuit 24 thus simplifying the circuit structure. The interval of the unison voice accorded by the synthesis circuit 26 to the output signal corresponding to the collected voice from the microphone amplifier 22 may be lower or higher than that of the output signal from the microphone amplifier 22. Of course, the intervals of the unison voices higher and lower than the interval of the voice of the singer may be used, if plural voices are added to the voice of the singer.

In the above-described first acoustic signal processing device 1 of the first embodiment, the digital signal obtained on A/D conversion by the A/D converter 4 from the output signals of the microphone amplifier 3 is synthesized by the synthesis circuit 5*b* of the unison voice generating unit 5 to the digital signal of the different interval from the interval of the voice collected by the microphone 2 and generated by the acoustic characteristics converting circuit 5*a*. Conversely, since no synthesis circuit for synthesis by digital signal processing is provided in the unison effect generator of the acoustic signal processing device 21 of the present second embodiment, the circuit structure can be simplified further than in the unison voice generating unit of the previous first embodiment.

In the first acoustic signal processing device 1 of the first embodiment, the digital signal from the A/D converter 4 is added with digital signals of different intervals, digital signals varied in frequency characteristics or with digital signals corresponding to echo signals, so as to be supplied via D/A converter 7 to the synthesis circuit 13. The result is that signals delayed by the digital signal processing by the generating unit 5 and the processing unit 6 are added by the synthesis circuit 13 to the output signal of the microphone amplifier 3. In the acoustic signal processing device 21 of the second embodiment, only the signal converted in acoustic characteristics is summed by the synthesis circuit to the output signal of the microphone amplifier 22.

Figure 4:
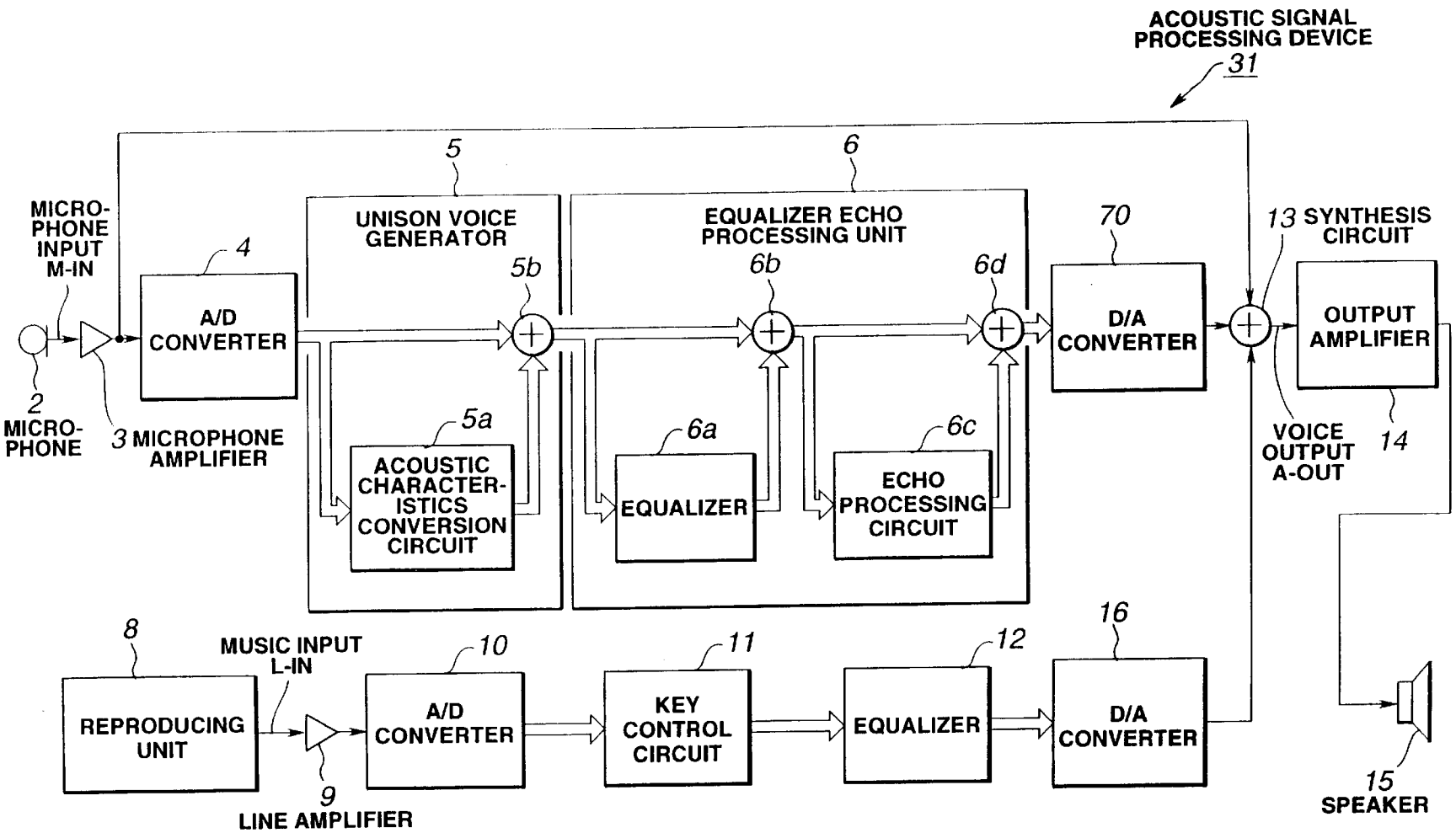
FIG. 4 is a is a block diagram of an acoustic signal processing apparatus according to a third embodiment of the present invention.

Referring to FIG. 4, an acoustic signal processing device 31 according to a third embodiment of the present invention is explained. In the acoustic signal processing device 31 of the present third embodiment, the same reference numerals are used to depict the same components as those of the previous first embodiment as shown in FIG. 2 and the detailed description for these common portions is omitted for simplicity.

The acoustic signal processing device 1 of the first embodiment is configured for summing an analog signal, obtained on D/A conversion by the D/A converter 70 of the the digital signal from the equalizer echo processor 6 and the digital signal from the equalizer 12, to the output signal of the microphone amplifier 3 by the synthesis circuit 13. The acoustic signal processing device 31 of the present third embodiment, on the other hand, is configured for summing an analog signal, as accompaniment information, obtained on D/A conversion of the digital signal from the equalizer 12 by the D/A converter 16, the analog signal from the D/A converter 16, and the output signal of the microphone amplifier 3, by the synthesis circuit 13. Since the output signal of the reproducing device 8 is varied by signal processing by the key control circuit 11 and the equalizer 12 for changing its interval and frequency characteristics and the resulting digital signal as accompaniment information is converted by the D/A converter 16 into analog signals which are then routed to the synthesis circuit 13, it becomes possible to use a D/A converter 70 having a smaller number of bits and a lower sampling frequency than those of the D/A converter 7 used in the acoustic signal processing device of the first embodiment. In other words, since it suffices for the D/A converter 70 of the acoustic signal processing device of the third embodiment to D/A convert the output digital signal of the equalizer echo processor 6, the signal processing time in the D/A converter 70 can be shortened as compared to that in the first embodiment, thus relieving the signal processing load in the D/A converter 70.

In the present third embodiment, since the output signal of the microphone amplifier 3 is directly routed to the synthesis circuit 13, as in the first embodiment, there is no risk of deterioration of signal quality of the output signal of the microphone amplifier 3 even if the voice of the singer is added to with the unison voice signal generated by the unison vice generator 5 and the signal from the equalizer echo processor 6 corrected for frequency characteristics.

Thus, in the acoustic signal processing device 31 of the present third embodiment, the A/D converter 4 for A/D converting the output signal of the microphone amplifier 3, A/D converter 10 for A/D converting the output signal of the line amplifier 9, D/A converter 7 for D/A converting the output of the equalizer echo processor 6 and the D/A converter 16 for D/A converting the output of the equalizer 12, which use a smaller number of bits and are more inexpensive than the A/D converters 103, 106 and the D/A converter 109 of the acoustic signal processing device 101 shown in FIG. 1, may be used. Of course, the A/D converters 4, 10 of the acoustic signal processing device 31 may be designed to be lower than the sampling frequency of the A/D converter 103. Alternatively, the A/D converters 4, 10 may be designed with smaller numbers of bits and with a lower sampling frequency than the A/D converter 103. The same holds for the D/A converters 7, 16.

In the above-described third embodiment, the digital acoustic signal of the interval different from that of the input speech signal, generated by the acoustic characteristics converting circuit 5*a*, is synthesized by the synthesis circuit 5*b* to the digital acoustic signal on the input side of the acoustic characteristics converting circuit 5*a*. Alternatively, it is also possible to use the circuit structure shown in FIG. 3, in which there is provided only the acoustic characteristics converting circuit 5*a* for outputting only the digital interval-converted acoustic signals having the different interval.

The equalizer echo processor 6 may be provided only with the equalizer 6*a* and the echo processing circuit 6*c* without being provided with the synthesis circuits 6*b*, 6*d* as in the above-described first and third embodiments. In such case, the equalizer echo processor 6 can output digital acoustic signals passed through the equalizer 6*a* and occasionally correct for frequency characteristics, if need be, and digital signals containing echo-processed echo components.

According to the acoustic signal processing device of the present invention, since the output signal of the microphone amplifier is added to with subsidiary unison voice signals and echo signals by the synthesis circuit, practically sufficient acoustic effects can be accorded to the microphone output without using high-performance A/D or D/A converters with a larger number of bits and a higher sampling frequency, thus simplifying the circuit structure and lowering the production cost. With the acoustic signal processing device of the present invention, there is produced no distortion of the voice of the singer by the dynamic constraint of the digital signal processor even if high-performance A/D or D/A converters are used.

What is claimed is:

1. An acoustic signal processing apparatus comprising:

a signal processor for converting an input analog speech signal of a single voice into a first digital signal and for generating a processed second digital signal based on predetermined acoustic characteristics added to the first digital input signal to produce a unison effect of a plurality of voices;

a digital/analog converter for converting the processed second digital signal generated by the signal processor into an analog processed signal; and a mixer for mixing the input analog speech signal with the analog processed signal output by said digital/analog converter.

2. The acoustic signal processing apparatus as claimed in claim 1, wherein said signal processor includes an analog/digital converter for converting the input analog speech signal into the first digital signal.

3. The acoustic signal processing apparatus as claimed in claim 2, wherein said signal processor further includes a converter for converting an interval of the input speech signal into an interval spaced by a pre-set pitch from the interval of the input speech signal.

4. The acoustic signal processing apparatus as claimed in claim 2, wherein said signal processor further includes an echo processor for adding an echo signal to the first digital signal.

5. The acoustic signal processing apparatus as claimed in claim 1, further an analog/digital converter for converting an input music information signal into a third digital signal, wherein the third digital signal is supplied to said digital/analog converter.

6. The acoustic signal processing apparatus as claimed in claim 5, further comprising an acoustic characteristics addition unit for adding the pre-set acoustic characteristics to the third digital signal from said analog/digital converter.

7. The acoustic signal processing apparatus as claimed in claim 1, further comprising an acoustic characteristics processing unit for adding the pre-set acoustic characteristics to input music information signals, wherein an output of the acoustic characteristics processing unit is supplied to said mixer.

8. The acoustic signal processing apparatus as claimed in claim 7, wherein said acoustic characteristics processing unit further comprises:

an analog/digital converter for converting the input music information signals into a digital signal;

an addition unit for adding acoustic characteristics to the digital signal from the analog/digital converter; and a digital/analog converter for converting an output signal from the addition unit into an analog signal.

* * * * *